US008289359B2

(12) United States Patent
Yokoi et al.

(10) Patent No.: US 8,289,359 B2
(45) Date of Patent: Oct. 16, 2012

(54) IMAGE FORMING APPARATUS AND METHOD OF MANUFACTURING THE SAME

(75) Inventors: Junichi Yokoi, Toyoake (JP); Yosuke Sugiyama, Gifu (JP); Yasuo Tamaru, Nagoya (JP); Toshio Sakai, Nagoya (JP)

(73) Assignee: Brother Kogyo Kabshiki Kaisha, Nagoya-shi, Aichi-ken (JP)

( * ) Notice: Subject to any disclaimer, the term of this patent is extended or adjusted under 35 U.S.C. 154(b) by 571 days.

(21) Appl. No.: 12/412,739

(22) Filed: Mar. 27, 2009

(65) Prior Publication Data

US 2009/0322851 A1 Dec. 31, 2009

(30) Foreign Application Priority Data

Jun. 30, 2008 (JP) ..... 2008-171040
Aug. 26, 2008 (JP) ..... 2008-216618

(51) Int. Cl.
*B41J 27/00* (2006.01)

(52) U.S. Cl. ..... 347/242; 347/238

(58) Field of Classification Search ..... 347/238, 347/242, 257
See application file for complete search history.

(56) References Cited

U.S. PATENT DOCUMENTS 5,339,132 A * 8/1994 Tomita et al. ..... 399/4
6,801,232 B2 10/2004 Nagamine et al.
7,777,769 B2 * 8/2010 Nozawa ..... 347/149
7,808,520 B2 * 10/2010 Nakajima ..... 347/238
2009/0169249 A1 * 7/2009 Watanabe et al. ..... 399/114

FOREIGN PATENT DOCUMENTS

JP 02-069344 5/1990
JP 2002-361931 12/2002

OTHER PUBLICATIONS

Machine Translation of JP2002-361931 submitted on Applicant's IDS.*
JP 2007-076028 Machine translation, Inventor: Gomi Tsugio, Assignee: Seiko, Date of Pub. Mar. 29, 2007, 25 pages.*

* cited by examiner

*Primary Examiner* — Julian Huffman
*Assistant Examiner* — Sharon A Polk
(74) *Attorney, Agent, or Firm* — Banner & Witcoff, Ltd

(57) ABSTRACT

An image forming apparatus is provided, which includes: a photosensitive member; an exposure member; a support frame supporting the exposure member; a gap keeping member; a pressing member; and an adjustment member. The adjust member is disposed between the exposure member and the support frame and configured to adjust a gap between the exposure member and the support frame to allow the exposure member to move in an optical axis direction.

21 Claims, 11 Drawing Sheets

IMAGE FORMING APPARATUS AND METHOD OF MANUFACTURING THE SAME

CROSS REFERENCE TO RELATED APPLICATION

The present disclosure relates to the subject matter contained in Japanese patent application Nos. 2008-171040 (filed on Jun. 30, 2008) and JP2008-216618 (filed on Aug. 26, 2008), each of which is expressly incorporated herein by reference in its entirety.

TECHNICAL FIELD

The present invention relates to an image forming apparatus exposing a photosensitive member such as a photosensitive drum by the use of an exposure member having plural light emitting portions such as LED heads.

BACKGROUND ART

JP-A-2002-361931 discloses an image forming apparatus exposing a photosensitive drum by the use of an LED head, in which a spacer maintaining a gap (hereinafter, also referred to as "operating distance") in an optical axis direction between the LED head and the photosensitive drum is disposed between the LED head and the photosensitive drum. In the image forming apparatus, an eccentric cam is disposed between the plate-like spacer and the LED head and the gap in the optical axis direction between the spacer and the LED head, that is, the operating distance, can be minutely adjusted by the use of the eccentric cam.

Since the operating distance is very small, the size of the eccentric cam or the spacer should be very small, thereby limiting the precision of adjustment using the eccentric cam or the stroke. When such limitation exists, it is possible to precisely set the operating distance, thereby deteriorating image quality.

Further, since the LED head is pressed to a photosensitive drum with the eccentric cam and the spacer interposed therebetween, a stress may be applied to the LED head itself and the LED head may be deformed. When the rigidity is enhanced by manufacturing the LED head out of aluminum die-cast to resist the deformation, the LED head increases in size, thereby increasing the cost thereof.

SUMMARY

The invention provides at least the following aspects:

(1) An image forming apparatus including: a photosensitive member; a support frame; a gap keeping member; a pressing member pressing; and an adjustment member. The adjustment member is disposed between the exposure member and the support frame and configured to adjust a gap between the exposure member and the support frame to allow the exposure member to move in an optical axis direction.

(2) An image forming apparatus including; a photosensitive member; an exposure member; a support frame; a gap keeping member; and a cam. The cam is disposed between the exposure member and the support frame and configured to adjust a gap between the exposure member and the support frame. The support frame includes a bearing portion configured to rotatably support the cam.

Therefore, an advantage of the invention is to precisely set the operating distance. Another advantage of the invention is to suppress the deformation of the exposure member.

These and other advantages of the invention will be discussed with reference to the accompanying drawings.

DESCRIPTION OF THE PREFERRED EMBODIMENT

First Embodiment

Figure 1:
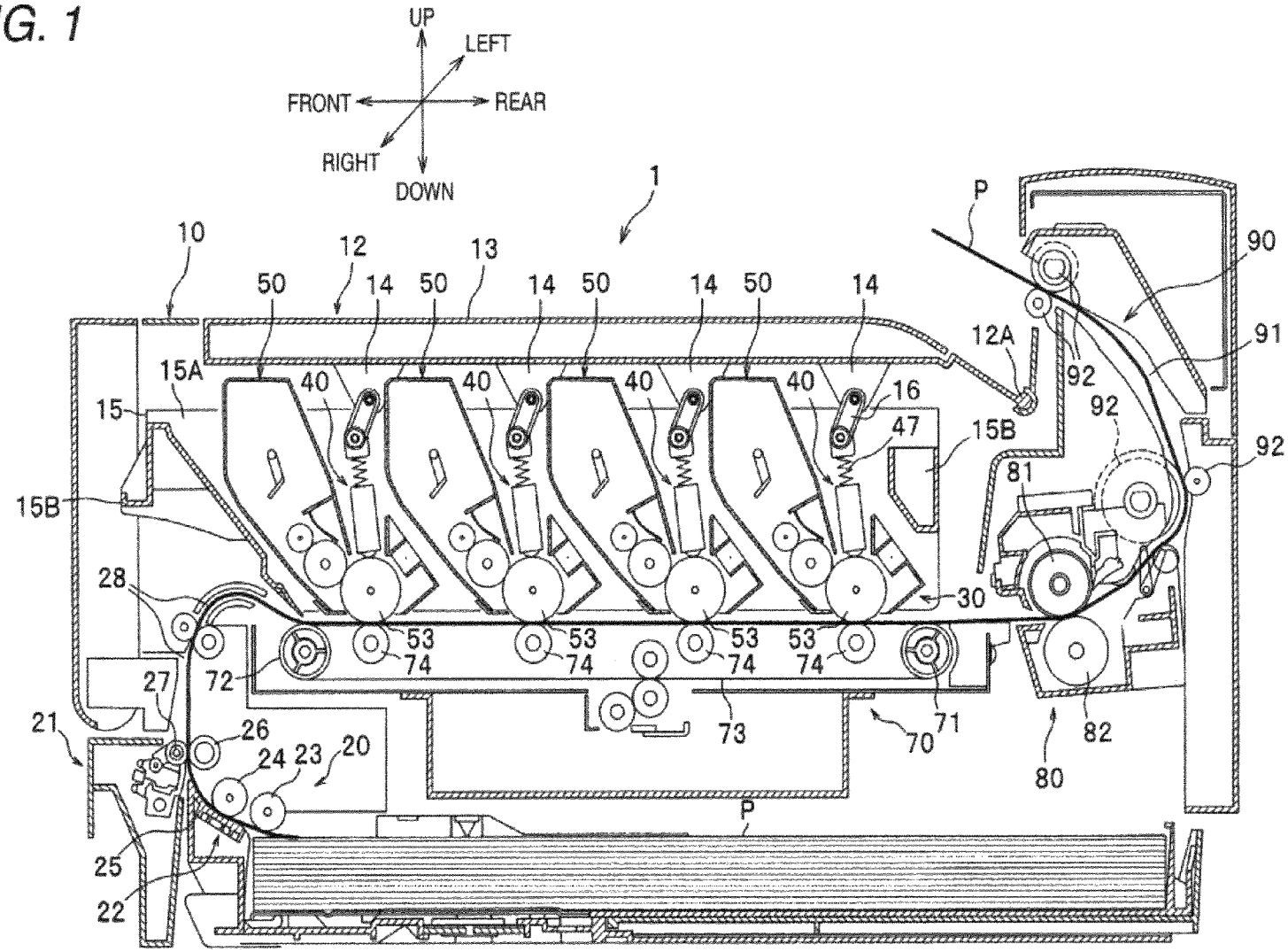
FIG. 1 is a sectional view illustrating the entire configuration of a color printer according to a first embodiment of the invention.

A first embodiment of the invention will be described in detail with reference to the accompanying drawings. FIG. 1 is a sectional view illustrating the entire configuration of a color printer.

In the following description, directions are described based on a user using the color printer. That is, in FIG. 1, the right side as facing the plane of paper is "front (near side)", the left side as facing the plane of paper is "rear (deep side)", the deep side as facing the plane of paper is "right", and the near side as facing the plane of paper is "left." The vertical direction as facing the plane of paper is "vertical direction."

As shown in FIG. 1, the color printer 1 includes a sheet feed unit 20 feeding a sheet P, an image forming unit 30 forming an image on the fed sheet P, and a sheet discharge unit 90 discharging the sheet P having the image formed thereon in a main chassis 10.

The upper portion of the main chassis 10 is provided with an upper cover 12 being freely opened and closed relative to the main chassis 10 so as to be vertically rotatable about a hinge 12A disposed in the rear side. The top surface of the upper cover 12 serves as a sheet discharge tray 13 on which the sheets P discharged from the main chassis 10 are piled and the bottom surface thereof is provided with plural LED attachment members 14 holding LED units 40 to be described later.

A main frame 15 detachably receiving the process cartridges 50 to be described later is disposed in the main chassis 10. The main frame 15 includes a pair of metal side frames 15A (only one is shown) disposed on the right and left sides thereof and a pair of cross members 15B connecting the pair of side frames 15A and being disposed on the front and rear sides thereof. The main frame 15 is fixed to the main chassis 10 or the like.

The sheet feed unit 20 is disposed in a lower portion of the main chassis 10 and includes a sheet feed tray 21 detachably disposed in the main chassis 10 and a sheet feed mechanism 22 transporting a sheet P from the sheet feed tray 21 to the image forming unit 30. The sheet feed mechanism 22 is disposed in front of the sheet feed tray 21 and includes a feed roller 23, a separation roller 24, and a separation pad 25.

In the sheet feed unit 20 having the above-mentioned configuration, the sheets P in the sheet feed tray 21 are separated sheet by sheet and are sent upward, paper powder is removed in the course of passing between a paper powder receiving roller 26 and a pinch roller 27, and the sheets are changed in direction to the rear direction by a transport passage 28 and then fed to the image forming unit 30.

The image forming unit 30 includes four LED units 40, four process cartridges 50, a transfer unit 70, and a fixing unit 80.

The LED unit 40 is rotatably supported by a connection member 16 rotatably connected to the LED attachment member 14 and is properly positioned by a positioning member disposed in the side frame 15A. The detailed structure of the LED unit 40 will be described later.

The process cartridges 50 are disposed in parallel in the front and rear directions between the upper cover 12 and the sheet feed unit 20 and includes a photosensitive drum 53 on which an electrostatic latent image is formed and a charger, a developing roller, and a toner containing chamber, of which the reference numerals are omitted and which are known.

The transfer unit 70 is disposed between the sheet feed unit 20 and the process cartridges 50 and includes a driving roller 71, a driven roller 72, a transport belt 73, and a transfer roller 74.

The driving roller 71 and the driven roller 72 are separated in the front and rear directions from each other in parallel and a transport belt 73 formed of an endless belt is suspended therebetween. The outer surface of the transport belt 73 is in contact with the respective photosensitive drums 58. Four transfer rollers 74 nipping the transport belt 73 along with the corresponding photosensitive drums 53 are disposed inside the transport belt 73 to face the corresponding photosensitive drums 53. At the time of transfer, a transfer bias is applied to the transfer rollers 74 by a static current control.

The fixing unit 80 is disposed in a deep side of the process cartridges 50 and the transfer unit 70 and includes a heating roller 81 and a pressing roller 82 disposed to face the heating roller 81 and to press the heating roller 81.

In the image forming unit 30 having the above-mentioned configuration, the surfaces of the photosensitive drums 53 are uniformly charged by the chargers and then are exposed by the LED units 40. Accordingly, the potential of the exposed portion is lowered and thus electrostatic latent images based on image data are formed on the photosensitive drums 53. Thereafter, toner is supplied to the electrostatic latent images from the developing roller, whereby toner images are formed on the photosensitive drums 53.

Then, a sheet P fed onto the transport belt 73 passes between the photosensitive drums 53 and the transfer rollers 74 disposed inside the transport belt 73, whereby the toner images formed on the photosensitive drums 53 are transferred onto the sheet P. Then, the sheet P passes between the heating roller 81 and the pressing roller 82, whereby the toner images transferred onto the sheet P are thermally fixed.

The sheet discharge unit 90 includes a discharge transporting passage 91 extending upward from the exit of the fixing unit 80 and being inverted to the front side and plural pairs of transport rollers 92 transporting the sheet P. The sheet P onto which a toner image is transferred and thermally fixed is transported through the discharge transport passage 91 by the transport rollers 92, is discharged out of the main chassis 10, and is piled on the sheet discharge tray 13.

Configuration of LED Unit

Figure 2:
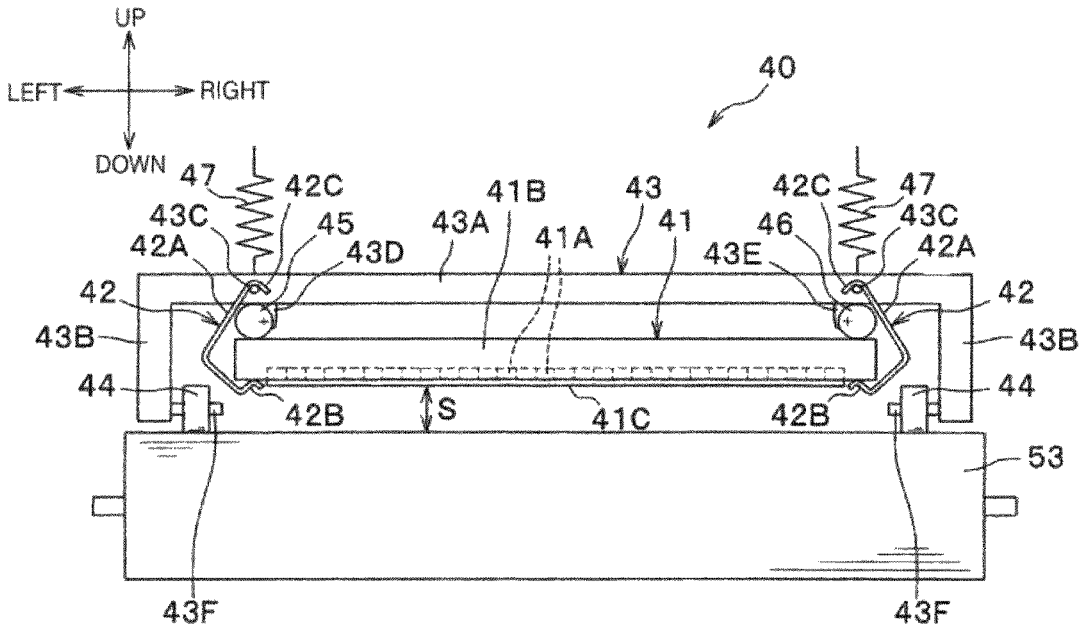
FIG. 2 is a front view illustrating a configuration of an LED unit.

A configuration of the LED unit 40 which is a featured part of the invention will be described in detail now. In the drawings, FIG. 2 is a front view illustrating a configuration of the LED unit, FIG. 3(*a*) is an exploded perspective view illustrating a left eccentric cam, and FIG. 3(*b*) is an exploded perspective view illustrating a right eccentric cam. FIG. 4 is a front view illustrating an example where a coarse adjustment plate is disposed between the eccentric cams and the LED head.

As shown in FIG. 2, the LED unit 40 includes an LED head 41, two line springs 42, a support frame 43 made of resin, two guide rollers 44, and two eccentric cams 45 and 46.

The LED head 41 includes plural LED arrays 41A in which plural LEDs are arranged in a semiconductor chip, a head frame 41B, and a lens array 41C.

The plural LED arrays 41A are arranged in a line with a predetermined pixel pitch in the lateral directions (the axis direction of the photosensitive drum 53) and properly emit light by the selective driving to emit light to the photosensitive drum 58. Specifically, each LED array 41A emits light in response to signals from a controller not shown on the basis of data of images to be formed to expose the photosensitive drum 53.

The head frame 41B is formed of resin and the plural LED arrays 41A are supported in the bottom portion. Since the head frame 41B is formed of resin, a decrease in size and cost of the LED head 41 is accomplished and the electric discharge from high-voltage components such as the charger is suppressed.

The lens array 41C includes plural SELFOC lenses (registered trademark) arranged to correspond to the LED arrays 43A, extends in the arrangement direction of the LID arrays 41A, and is fixed to the head frame 41B in a state where both ends of the bottom surface of the head frame 41B are slightly left.

The line spring 42 is a linear attracting spring having a substantially V shape and urges the LED head 41 to the support frame 43. Specifically, the line spring 42 includes a body portion 42A having a V shape, an operating portion 42B formed at a lower end of the body portion 42A, and an engagement pawl 42C formed at the upper end of the body portion 42A.

The body portion 42A is curved in a V shape so as to expose operation portions (cross grooves 45C and 46C to be described later; see FIGS. 3(*a*) and 3(*b*)) the eccentric cams 45 and 46 to be described later.

The operating portion 42B is a portion applying a pressing force to the LED head 41 and is in contact with a portion on the bottom surface of the head frame 41B located outside the plural LED arrays 41A (lens array 41C) in the lateral directions. The operating portion 42B is bent upward and then curved downward to from a V shape. Accordingly, the contact portion between the operating portion 42B and the head frame 413 has substantially a point shape.

The engagement pawl 42C has a V shape so as to be hooked on the top surface of an engagement pin 43*c* of the support frame 43 to be described later.

The support frame 43 supports the LED head 41 via the line spring 42 and includes a base portion 43A extending in the lateral direction and a pair of extension portions 43B extending downward from both ends of the base portion 43A.

In the base portion 43A, the engagement pins 43C supporting the line spring 42 and the bearing portions 43D and 43E supporting the eccentric cams 45 and 46 are formed at two symmetric positions, respectively. Two coil springs 47 pressing down the support frame 43 to the photosensitive drum 53 are disposed at symmetric positions on the top surface of the base portion 48A. Accordingly, the support frame 43 is pressed with good balance in the lateral direction by the two coil springs 47.

Each extension portion 43B has such a length that the extension portion more protrudes downward than the bottom surface of the LED head 41 supported by the base portion 43A via the line spring 42. A shaft 43F rotatably supporting the guide roller 44 is disposed at the lower end thereof.

Each guide roller 44 is a cylindrical member and disposed rotatable about the shaft 43F located at the lower end of the extension portion 43B of the support frame 43. That is, the guide roller is separated from the LED head 41 by a predetermined distance. The guide rollers 44 are pressed to the photosensitive drum 53 with the urging force transmitted from the coil springs 47 through the support frame 43 and rotates with the rotation of the photosensitive drum 53. When the guide rollers 44 come in contact with the photosensitive drum 53 and thus the photosensitive drum 53 is decentered, the gap (operating distance S) in the optical axis direction between the photosensitive drum 53 and the LED head 41 supported by the support frame 43 is kept.

In other words, the guide rollers 44 keep the gap between the LED head 41 and the photosensitive drum 53 by the use of the support frame 43. That is, the gap between the support frame 43 and the photosensitive drum 53 is kept by the guide rollers 44 and the LED head 41 is supported by the support frame 43 of which the gap from the photosensitive drum 53 is kept, whereby the gap between the LED head 41 and the photosensitive drum 53 is kept.

The guide rollers 44 may come in contact with a photosensitive layer (layer to be exposed) of the surface of the photosensitive drum 53 or may come in contact with the areas (areas having no photosensitive layer) outside the photosensitive layer in the lateral direction.

The eccentric cams 45 and 46 are disposed between the LED head 41 and the base portion 43A of the support frame 48 and press the LED head 41 in the optical axis direction with the urging of the line spring 42. Specifically, the eccentric cams 45 and 46 are disposed at positions coming in contact with the portions outside the plural LED arrays 41A (lens array 41C) on the top surface of the head frame 41B so as to overlap with the operating portion 42B of the line spring 42 as viewed in the urging direction (vertical direction) of the line spring 42.

Figure 3:
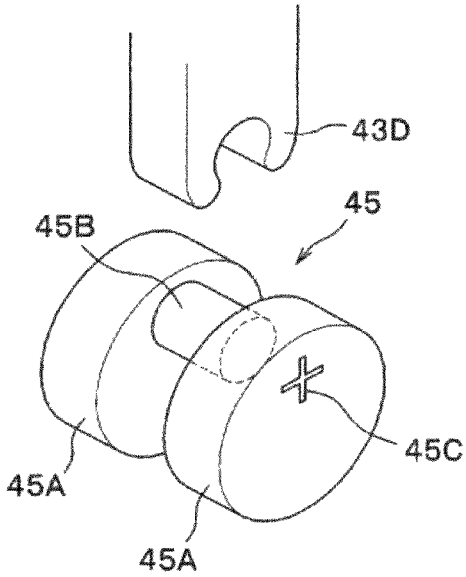
FIG. 3(*a*) is an exploded perspective view illustrating a left eccentric cam and FIG. 3(*b*) is an exploded perspective view illustrating a right eccentric cam.
Figure 3:
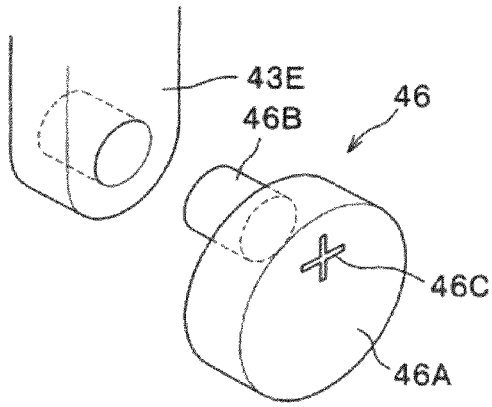
Figure 4:
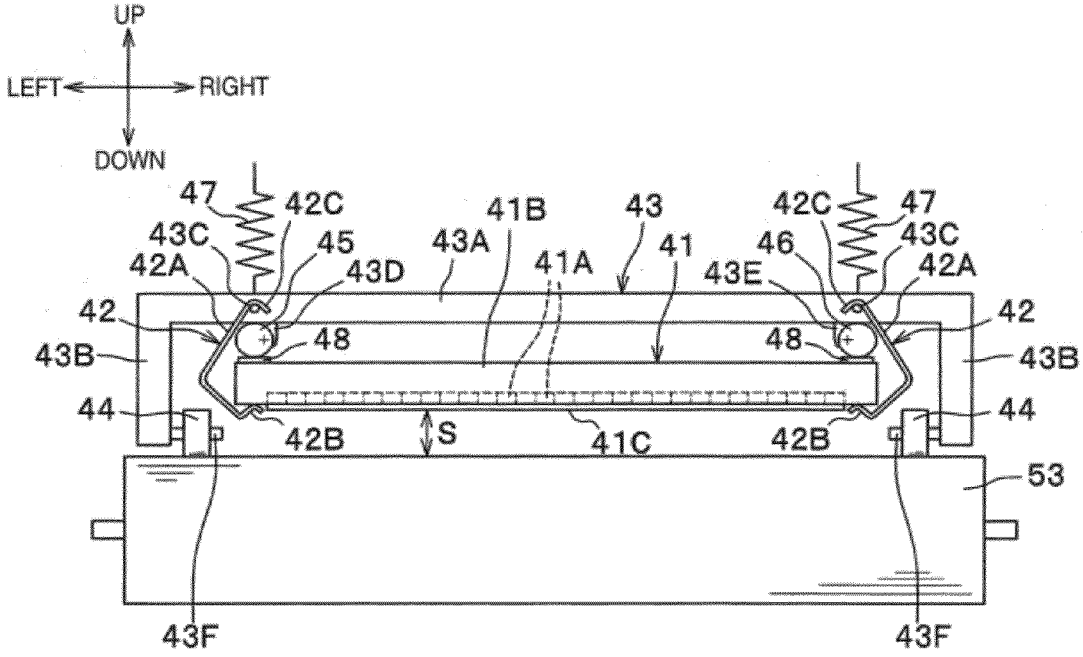
FIG. 4 is a front view illustrating an example where a coarse adjustment plate is disposed between the eccentric cam and the LED head.

As shown in FIG. 3(*a*), the left eccentric cam 45 of the pair of eccentric cams 45 and 46 presses the LED head 41 at two positions and as shown in FIG. 3(*b*), the right eccentric cam 46 presses the LED head 41 at one position. That is, all the eccentric cams 45 and 46 and the LED head 41 come in contact with each other at three positions.

Specifically, as shown in FIG. 3(*a*), the left eccentric cam 45 includes two cylindrical portions 45A disposed coaxially and one shaft 45B connecting the cylindrical portions 45A at a position departing from the centers of the cylindrical portions 45A.

The shaft 45B of the eccentric cam 45 is inserted into a C-shaped bearing portion 43D of the support frame 43 and thus is rotatably supported by the bearing portion 43D with predetermined tightness hardly to move). Here, the tightness between the shaft 45B and the bearing portion 43D is set to such an extent that the eccentric cam 45 does not rotate with the urging force of the line spring 42.

A cross groove 45C of which the center corresponds to the center of the shaft 45B is formed on an end surface of the cylindrical portion 45A of the eccentric cam 45. By allowing a plus driver to engage with the cross groove 45C and turning the plus driver by a predetermined distance with a force greater than the urging fore of the line spring 42, the eccentric cam 45 rotates about the support frame 43 by the predetermined distance and is kept at the position.

As shown in FIG. 3(*b*), the right eccentric cam 46 has a shape obtained by removing one cylindrical portion 45A from the left eccentric cam 45. That is, the right eccentric cam 46 includes a cylindrical portion 46A, a shaft 46B, and a cross groove 46C, similarly to the left eccentric cam 45. The shaft 46B of the eccentric cam 46 is inserted into a substantially cylindrical bearing portion 43E of the support frame 43 and is rotatably supported by the bearing portion 43E with the same tightness as described above.

In the LED unit 40 having the above-mentioned configuration, as shown in FIG. 2, the guide rollers 44 come in contact with the photosensitive drum 53, whereby the support frame 43 is located at a predetermined position relative to the photosensitive drum 53. The LED head 41 is pressed against the eccentric cam 45 and 46 supported by the support frame 43 positioned as described above, whereby the LED head 41 is positioned relative to the photosensitive drum 53.

By properly operating the eccentric cams 45 and 46 in this state, the LED head 41 goes ahead and back relative to the support frame 43 and thus the operating distance S is minutely adjusted. Since the operating distance S greatly varies due to the influence of manufacturing errors of the guide rollers 44, the support frame 43, the eccentric cams 45 and 46, and the LED head 41, the operating distance S may not be set to a desired value with only the adjustment range of the eccentric cams 45 and 46. In this case, as shown in FIG. 4, a coarse adjustment plate coarsely adjusting the operating distance S may be properly disposed between the eccentric cams 45 and 46 and the LED head 41.

Method of Manufacturing Color Printer

A method of manufacturing a color printer 1 will be described now. In the drawings, FIG. 5(*a*) is a front view illustrating a first process and a second process, FIG. 5(*b*) is a front view illustrating a third process, and FIG. 5(*c*) is a front view illustrating a fourth process.

Figure 5:
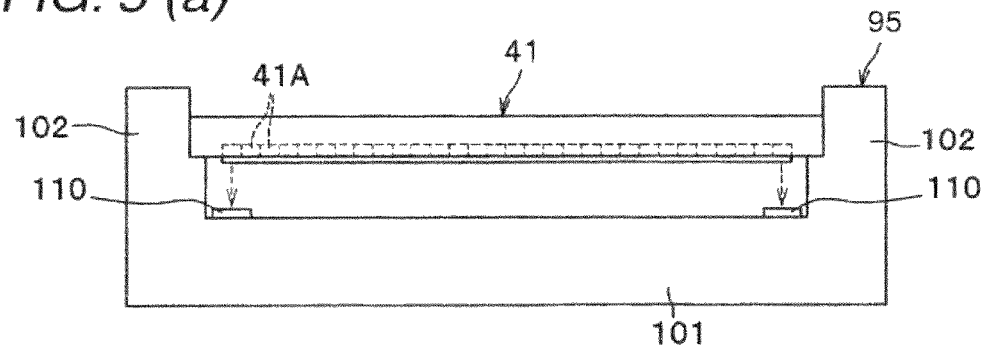
FIG. 5(*a*) is a front view illustrating a first process and a second process, FIG. 5(*b*) is a front view illustrating a third process, and FIG. 5(*c*) is a front view illustrating a fourth process.
Figure 5:
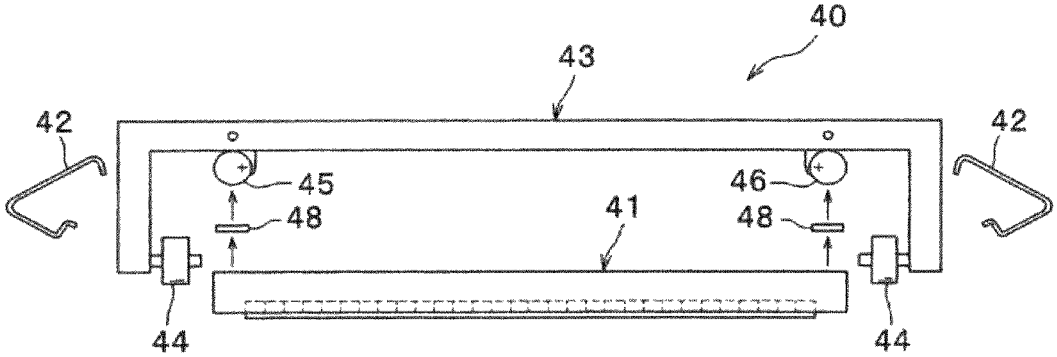
Figure 5:
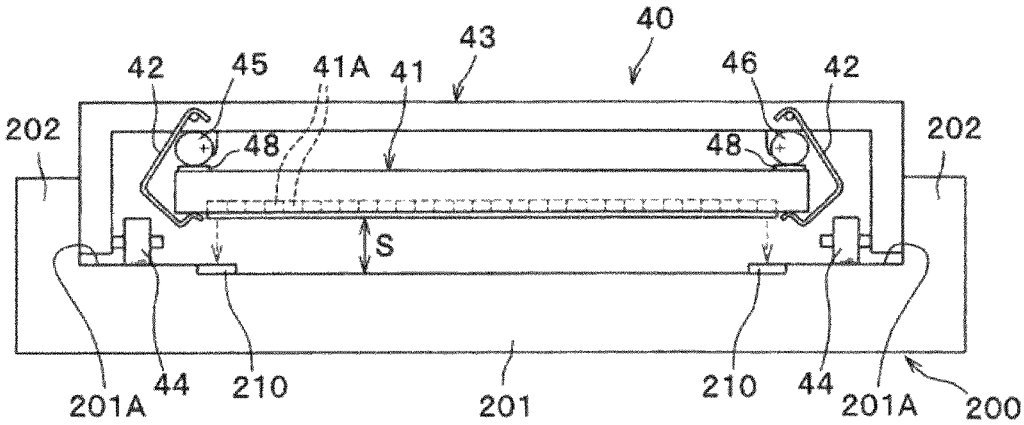

As shown in FIG. 5(*a*), first, a first jig 95 is set in the LED head 41. Here, the first jig 95 includes a bottom wall 101 facing the plural LED arrays 41A arranged in a line in the lower portion of the LED head 41 and a pair of support portions 102 protruding upward from the bottom wall 101 to support the LED head 41. The bottom wall 101 is provided with two first optical sensors 110 receiving light emitted from two LED arrays 41A located at both ends among the plural LED arrays 41A arranged in a line.

Light is emitted from the LED arrays 41A to the first optical sensors 110 to measure a displacement distance of a focal position of the light first process). Then, it is determined whether the coarse adjustment plate 48 should be disposed on the basis of the measured displacement distance of the focal position (second process).

Specifically, in the second process, for example, a distance between the surface of the first optical sensors 110 (corresponding to the surface of the photosensitive drum 53) and the LED head 41 is measured on the basis of the displacement distance of the focal position. When the distance is greater than the desired operating distance S by a predetermined value (a value in the adjustment width range of the eccentric cams 45 and 46), it is determined that the coarse adjustment plate 48 should not be disposed. When the distance between the first optical sensors 110 and the LED head 41 is greater than a distance obtained by adding the predetermined value to the desired operating distance S, it is determined that the coarse adjustment plate 48 should be disposed.

Thereafter, the LED head 41 is detached from the first jig 95, the coarse adjustment plate 48 is disposed relative to the support frame 43 to which the eccentric cams 45 and 46 are attached as shown in FIG. 5(*b*), and the LED head 41 is attached thereto by the use of the line spring 42. The guide rollers 44 are attached to the support frame 43 (third process). Here, the attachment of the guide rollers 44 may be performed before or after the LED head 41 is attached the support frame 43.

The assembled LED unit 40 is set in a second jig 200 as shown in FIG. 5(*c*). Here, the second jig 200 includes a bottom wall 201 facing the plural LED arrays 41A and a pair of support portions 202 protruding upward from the bottom wall 201 to support the support frame 43. The bottom wall 201 is provided with two second optical sensors 210 receiving light emitted from two LED arrays 41A located at both ends of the plural LED arrays 41A arranged in a line and a reference surface 201A coming in contact with the guide rollers 44 are formed therein.

By operating the eccentric cams 45 and 46 supplied with the urging force from the line spring 42 while emitting light to the second optical sensors 210 from the LED arrays 41A of the LED unit 40 in a state where the guide rollers 44 are brought into contact with the reference surface 201A, the focal position of light is adjusted to a predetermined position relative to the reference surface 201A (fourth process). Accordingly, the LED head 41 is positioned relative to the reference surface 201A corresponding to the surface of the photosensitive drum 53 and thus the operating distance S is set to a desired value.

Thereafter, as shown in FIG. 1, the LED unit 40 is connected to the upper cover 12 by the use of the coil spring 47, the connection member 16, and the LED attachment members 14 and the constituent components of the sheet feed unit 20, the image forming unit 30, the sheet discharge unit 90, and the like are attached to the main chassis 10, thereby completing the color printer 1.

According to the above-mentioned configuration, the following advantages can be obtained in this embodiment.

Since the gap between the LED head 41 and the support frame 43 is adjusted by providing the guide rollers 44 to the support frame 43 and disposing the eccentric cams 45 and 46 between the LED head 41 and the support frame 43, it is possible to increase the sizes of the guide rollers 44 and the eccentric cams 45 and 46, compared with the past case where the spacer and the eccentric cam are disposed in a narrow gap between the LED head and the photosensitive drum. Accordingly, it is possible to improve the precision in adjustment using the eccentric cams 45 and 46 and to enlarge the stroke of the LED head 41 moving with the pressing of the eccentric cams 45 and 46. In this way, it is possible to precisely set the operating distance S. In addition, since the large guide rollers 44 being rotatable can be employed as the gap keeping member instead of the past thin spacer, it is possible to suppress the abrasion of the guide rollers 44 or the photosensitive drum 53.

Since the coil spring 47 presses the guide rollers 44 to the photosensitive drum 53 with the support frame 43 interposed therebetween, a load from the coil spring 47 is not applied to the LED head 41 supported by the support frame 43 with the line spring 42 interposed therebetween, thereby preventing the deformation of the LED head 41. Since the load is not applied to the LED head 41 in this way and thus the LED head 41 can be formed of resin like this embodiment, it is possible to reduce the size and the cost of the LED head 41 and to prevent the electric discharge from high-voltage components such as the charger.

The coarse adjustment plate 48 is properly disposed between the eccentric cams 45 and 46 and the LED head 41. Accordingly, even when the operating distance S cannot be set to a desired value with only the adjustment width of the eccentric cams 45 and 46 due to the manufacturing errors or the like, the operating distance S can be set to a desired value by the use of the coarse adjustment plate 48.

Since the LED head 41 is supported by the support frame 43 by the use of the line spring 42, it is possible to adjust the operating distance S by operating the eccentric cams 45 and 46 in a state where the attachment of the LED unit 40 is completed.

Since the operating portions 42B of the line springs 42 and the eccentric cams 45 and 46 are disposed outside the LED arrays 41A of the LED head 41 in the lateral direction, both ends of the LED head 41 is nipped between the operating portions 42B of the line springs 42 and the eccentric cams 45 and 46 and thus the LED head 41 can be stably supported. Since the operating portions 42B of the line springs 42 and the eccentric cams 45 and 46 are disposed to overlap with each other as viewed in the urging direction of the line springs 42, the pressing force applied from the eccentric cams 45 and 46 to the LED head 41 can be made to be substantially equal to the urging force of the line springs 42 in the lateral direction, thereby preventing the deformation of the LED head 41.

Since the line springs 42 are bent to expose the cross grooves 45C of the eccentric cams 45 and 46, it is possible to easily operate the eccentric cams 45 and 46.

Since all the eccentric cams 45 and 46 and the LED head 41 come in contact with each other at three contact portions, the LED head 41 urged to the eccentric cams 45 and 46 can be stably supported at three points.

The invention is not limited to the first embodiment, but may be modified in various forms as described below.

In the first embodiment, the line springs 42 are employed as the elastic member, but the invention is not limited to this configuration. For example, leaf springs 300 shown in FIGS. 6(*a*) and 6(*b*) may be employed. Specifically, each leaf spring 300 includes a body portion 310 extending in the vertical direction, an operating portion 320 formed at the lower end of the body portion 310 to press the LED head 41 to the support frame 43, and an engagement pawl 330 formed at the upper end of the body portion 310 to engage with the top surface of the support frame 43.

Openings 311 exposing the cross grooves 45C and 46C of the eccentric cams 45 and 46 are formed in the body portions 310, respectively. Accordingly, it is possible to easily operate the eccentric cams 45 and 46.

In the first embodiment, the eccentric cams 45 and 46 are employed as the adjustment member, but the invention is not limited to this configuration. For example, an egg-like cam may be employed or screws 400 shown in FIG. 7(*a*) may be employed. Specifically, the screws 400 are inserted into the support frame 43 to vertically penetrate the support frame 43 in a state where operating portions (operating screw heads) are directed to the upside.

Figure 7:
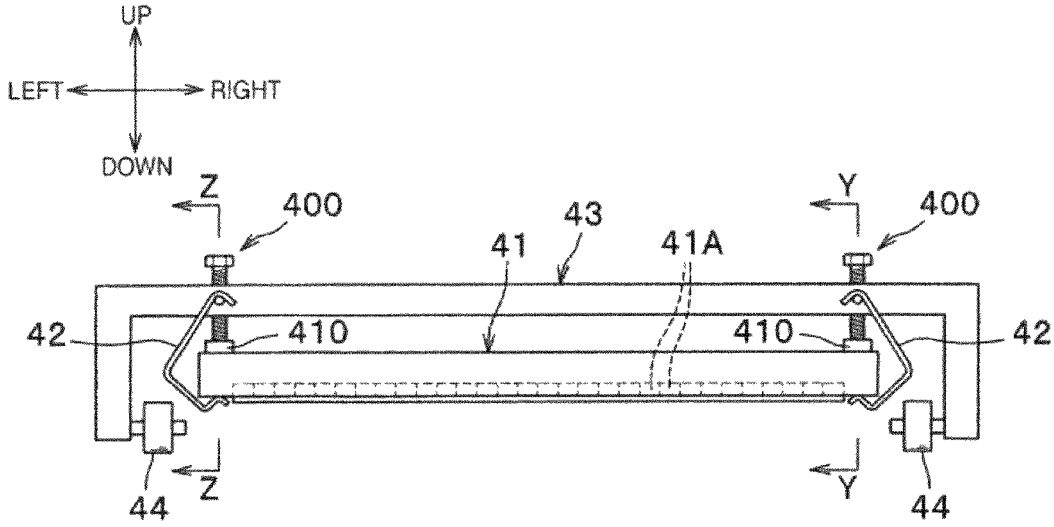
FIG. 7(*a*) is a front view illustrating an example where a screw is employed as an adjustment member, FIG. 7(*b*) is a sectional view taken along line Y-Y of FIG. 7(*a*), and FIG. 7(*c*) is a sectional view taken along line Z-Z of FIG. 7(*a*).
Figure 7:
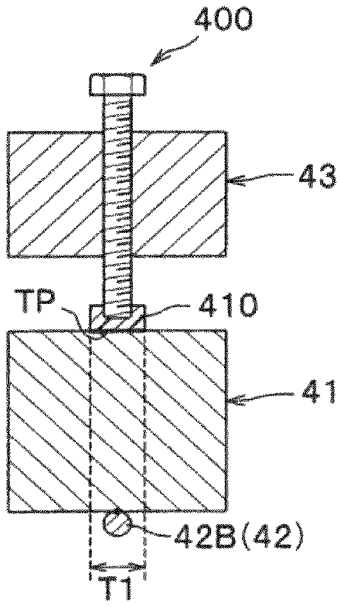
Figure 7:
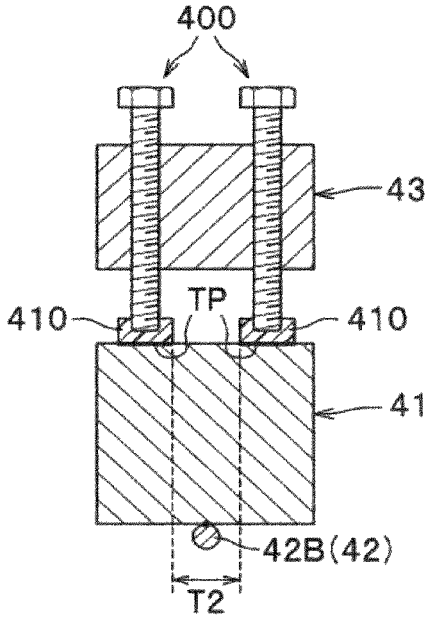

One screw 400 is disposed on the right side of the support frame 43 (see FIG. 7(*b*)) and two screws 400 are disposed with a predetermined gap therebetween on the left side of the support frame 43 (see FIG. 7(*c*)). More specifically, the screws 400 are disposed outside the plural LED arrays 41A in the lateral direction.

A contact member 410 having a diameter greater than the lower end surface of each screw 400 is bonded to the lower end of the screw 400. Accordingly, as shown in FIG. 7(*b*), the operating portion 42B of the line spring 42 (specially, the portion coming in contact with the LED head 41) is smaller than the contact portion TP of the screw 400 and the LED head 41 on the right side of the support frame 43.

The operating portion 42B having a small size is disposed in the range T1 of the contact portions TP. Accordingly, the pressing force applied from the contact portions 410 of the screw 400 to the LED head 41 can be made to be further equal to the urging force of the line springs 42 in the lateral direction, thereby further preventing the deformation of the LED head 41. Since the pressing force of contact members 410 is equal to the urging force of the line springs 42 in the front and rear directions, it is possible to prevent the LED head 41 from being inclined in the front and rear directions.

As shown in FIG. 7(*c*), the operating portion 42B (specifically, the portion coming in contact with the LED head 41) is smaller than the range T2 between the two contact portions TP on the left side of the support frame 43. The operating portion 42B having a small size is disposed in the range T2 between the two contact portions TP.

Accordingly, the pressing force applied from the two contact members 410 to the LED head 41 can be made to be further equal to the urging force of the line springs 42 in the lateral direction, thereby further preventing the deformation of the LED head 41. Since the operating portions 42B of the line springs 42 are disposed between the two contact members 410 extending in the front and rear directions, it is possible to prevent the LED head 41 from being inclined in the front and rear directions.

In FIG. 7(*c*), even when the operating portion 42B of the line springs 42 is disposed in the range of one contact portion TP of the two contact portions TP, the same advantages as described above can be obtained.

Figure 8:
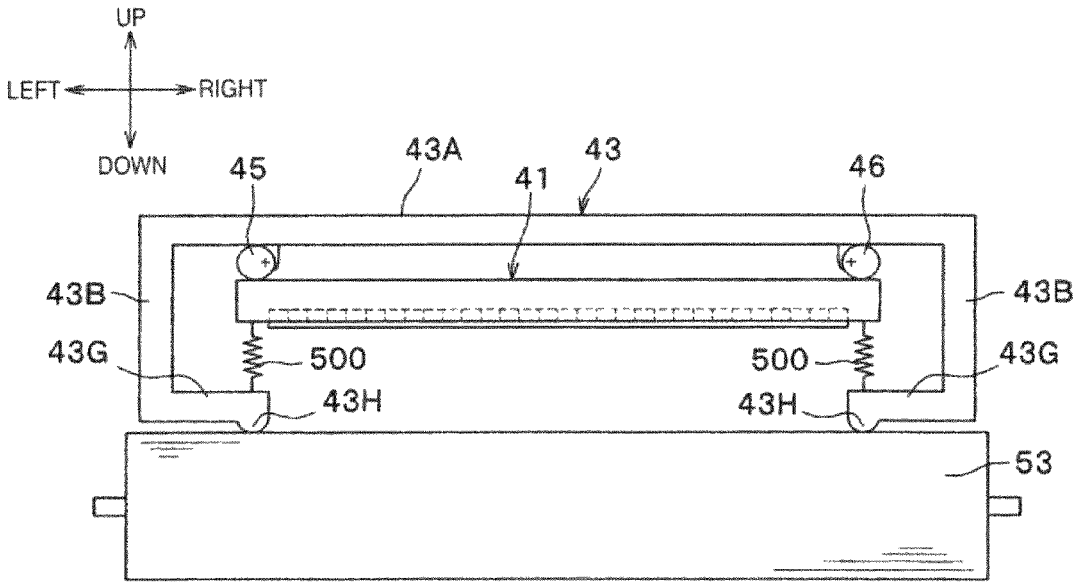
FIG. 8 is a front view illustrating an example where a coil spring which is a compression spring is employed as the elastic member.

In the first embodiment, an attracting spring (line springs 42) attracting the LED head 41 to the support frame 43 is employed as the elastic member, but the invention is not limited to this configuration. A pressing spring pressing the LED head to the support frame may be employed Specifically, for example, as shown in FIG. 8, base seat portions 43G extending inward in the lateral direction from the extension portions 43B of the support frame 43 according to this embodiment and facing the lower surface of the LED head 41 may be provided and coil springs 500 may be disposed between the top surface of the base seat portions 43G and the lower surfaces of both ends of the LED head 41. In this case, since the LED head 41 is pressed to the support frame 43 (base portion 43A) by the coil springs 500, the LED head 41 can be made to go ahead and back in the optical axis direction by the use of the eccentric cams 45 and 46 disposed between the LED head 41 and the support frame 43, similarly to the above-mentioned embodiment.

Like the modified example shown in FIG. 8, slide contact portions 43H protruding form the lower surface of the base seat portions 43G and coming in slide-contact with the photosensitive drum 53 may be provided as the gap keeping member instead of the guide rollers 44 according to the first embodiment. That is, a non-rotating member may be employed as the gap keeping member. However, when the rotating guide rollers 44 are employed like the above-mentioned embodiment, the abrasion of the guide rollers 44 or the photosensitive drum 53 is suppressed and thus the guide rollers 44 are preferably employed. The gap keeping member may be provided to the frame rotatably supporting the photosensitive drum 53.

Figure 9:
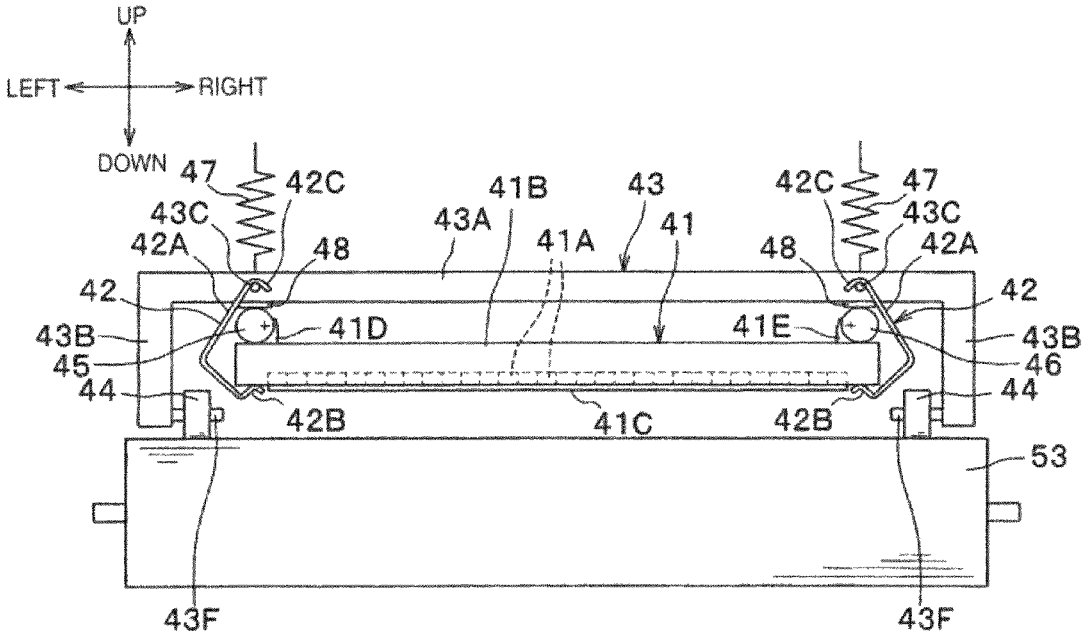
FIG. 9 is a front view illustrating an example where an eccentric cam is disposed in the LED head.

In the first embodiment, the eccentric cams 45 and 46 are disposed in the support frame 43, but the invention is not limited to this configuration. As shown in FIG. 9, the eccentric cams may be disposed in the LED head 41. Specifically, the same bearing portions 41D and 41E as the bearing portions 43D and 43E (see FIG. 3) according to the above-mentioned embodiment may be disposed on the top surface of the LED head 41 and the same eccentric cams 45 and 46 as the above-mentioned embodiment may be attached to the bearing portions 41D and 41E. In this case, the coarse adjustment plate 48 may be properly disposed between the support frame 43 and the eccentric cams 45 and 46. In this case, when the eccentric cams 45 and 46 are made to rotate, the eccentric cams 45 and 46 can press the support frame 43 (or the coarse adjustment plate 48) to allow the LED head 41 to go ahead and back in the optical axis direction.

In the first embodiment, the number of contact portions of all the eccentric cams 45 and 46 and the LED head 41 is three, but the invention is not limited to this configuration. The number of contact portions may be four or more, or may be two when the contact portions are formed in a plane shape.

In the first embodiment, the cross grooves 45C and 46C are employed as the operating portion, but the invention is not limited to this configuration. A line-like groove engaging with a minus driver, a polygonal hole engaging with a polygonal wrench such as a hexagonal wrench, or a protrusion grasped with pliers or the like may be employed.

Second Embodiment

A second embodiment of the invention will be described in detail with reference to FIGS. 10 to 13. Elements of the second embodiment having the same functions as the elements of the first embodiment are referenced by like reference numerals and repeated description thereof is omitted.

Figure 10:
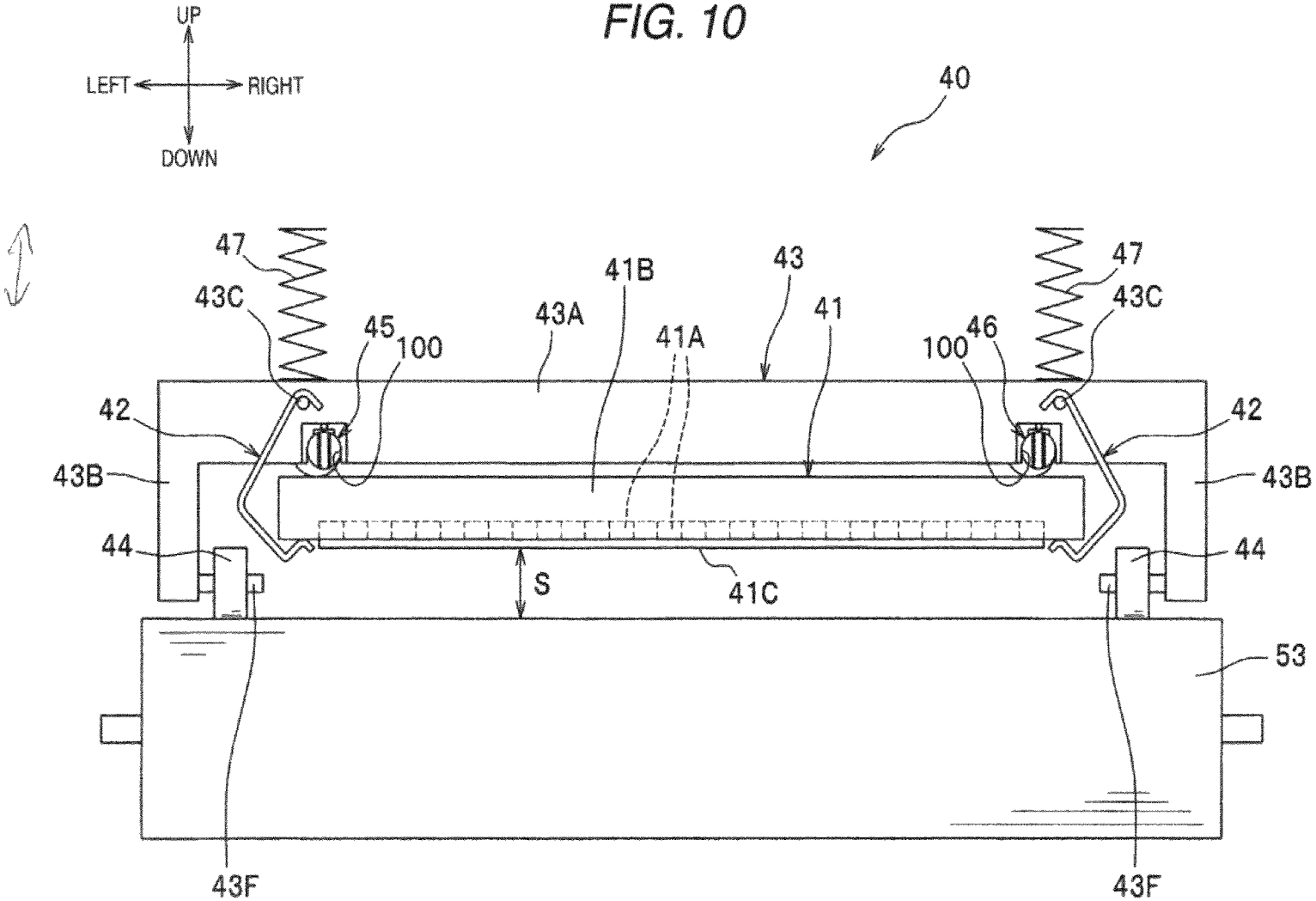
FIG. 10 is a front view illustrating a configuration of an LED unit according to a second embodiment of the invention.

As shown in FIG. 10, in the base portion 43A of the second embodiment, two engagement pins 43C supporting the line springs 42 and two bearing portions 100 rotatably supporting the eccentric cams 145 and 146 are formed at symmetric positions, respectively.

The eccentric cams 145 and 146 serve to adjust the gap between the LED head 41 and the support frame 43 and are disposed between the LED head 41 and the base portion 43A of the support frame 43. The eccentric cams 145 and 146 press the LED head 41 in the optical axis direction with the urging force of the line springs 42.

The left eccentric cam 145 of a pair of eccentric cams 145 and 146 presses the LED head 41 at one point and the right eccentric cam 146 presses the LED head 41 at two points. That is, the entire eccentric cams 145 and 146 come in contact with the LED head 41 at three positions. In the following description, the left eccentric cam 145 is also referred to as "first cam 145" and the right eccentric cam 146 is also referred to as "second cam 146."

Figure 11:
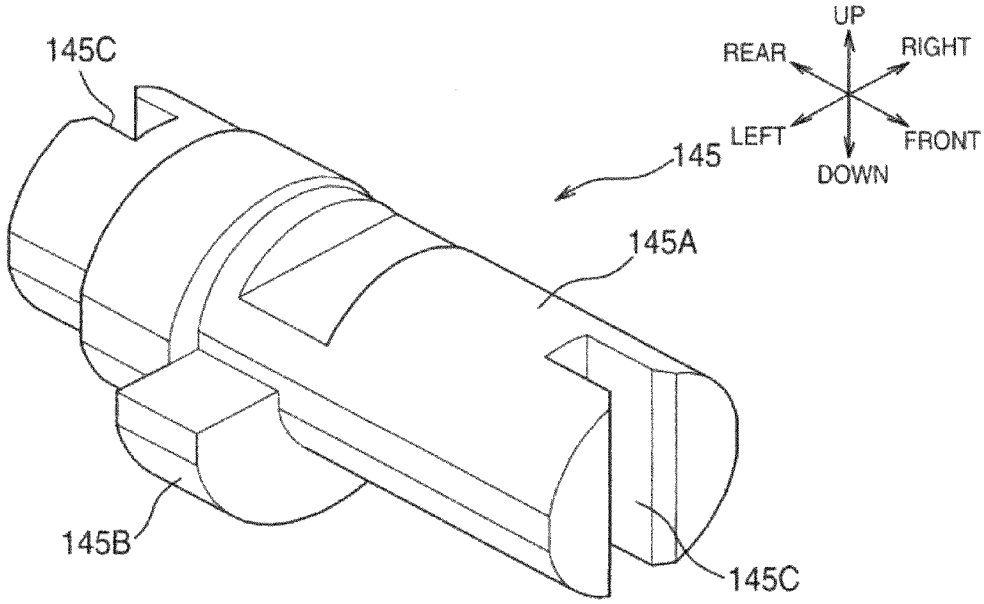
FIG. 11(*a*) is a perspective view illustrating a first cam and FIG. 11(*b*) is a perspective view illustrating a second cam.
Figure 11:
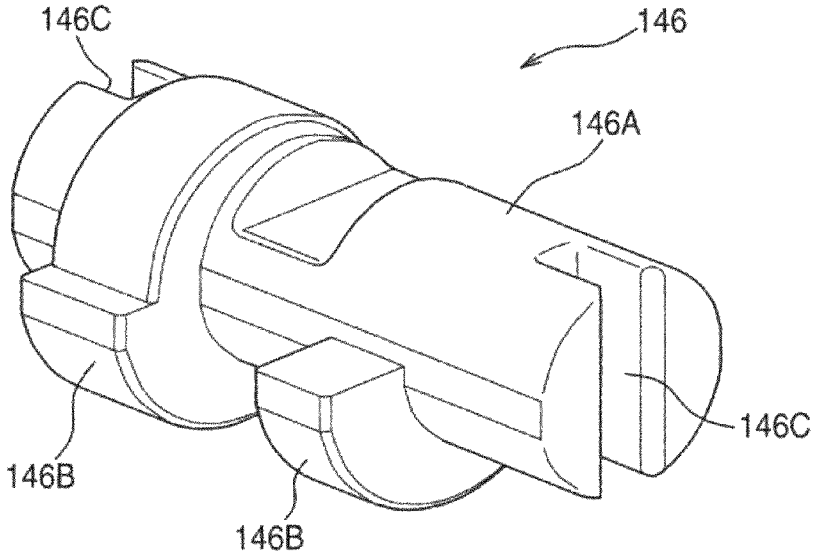

Specifically, as shown in FIG. 11(*a*), the first cam 145 includes a shaft 145A having a substantially cylindrical shape, an operating portion 145B formed to protrude from the outer circumferential surface of the shaft 145A, and minus grooves 145C formed at both ends of the shaft 145A.

The length (length in the axis direction) of the shaft 145A is smaller than the width of the LED head 41 and the support frame 43 (see FIG. 1). Here, the width of the LED head 41 and the support frame 43 means a width in the front and rear directions in this embodiment and in other words, means a width in a direction perpendicular to the axis of the photosensitive drum 53 (photosensitive member) and the optical axis of light emitted from the LED head 41.

Both ends of the shaft 145A are rotatably supported by the bearing portion 100 of the support frame 43 with predetermined tightness (rotation resistance). Here, the tightness of the shaft 145A and the bearing portion 100 is set to such an extent that the first cam 145 does not rotate with the urging force of the line spring 42.

The operating portion 145B has a semi-circular shape and is formed monolithically with the shaft 145A so that the center (the center of the semicircle) is decentered from the center of the shaft 145A.

The minus groove 145C is formed to penetrate the shaft 145A in the diameter direction of the shaft 145A. Accordingly, by allowing a minus driver to engage with the minus groove 145C and allowing the minus driver to rotate by a predetermined angle with a force greater than the urging force of the line spring 42, the first cam 145 is made to rotate by a predetermined angle relative to the support frame 43 and is kept at the position.

As shown in FIG. 11(*b*), the second cam 146 includes the same shaft 146A, operating portion 146B, and minus grooves 146C as the first cam 145, but is different from the first cam 145 in that it has two operating portions 146B.

The detailed structure of the bearing portion 100 will be described now. In the drawings, FIG. 12(*a*) is an enlarged perspective view illustrating a structure around the bearing portion and FIG. 12(*b*) is an enlarged perspective view illustrating a state where an adhesive is filled in a concave portion around the bearing portion. FIG. 13 is a side view illustrating a state where an adhesive is applied between the shaft of the first cam and the LED head. Only the structure of the bearing portion 100 of the first cam 145 will be described below and the bearing portion 100 of the second cam 146 having the same structure will not be described.

Figure 12:
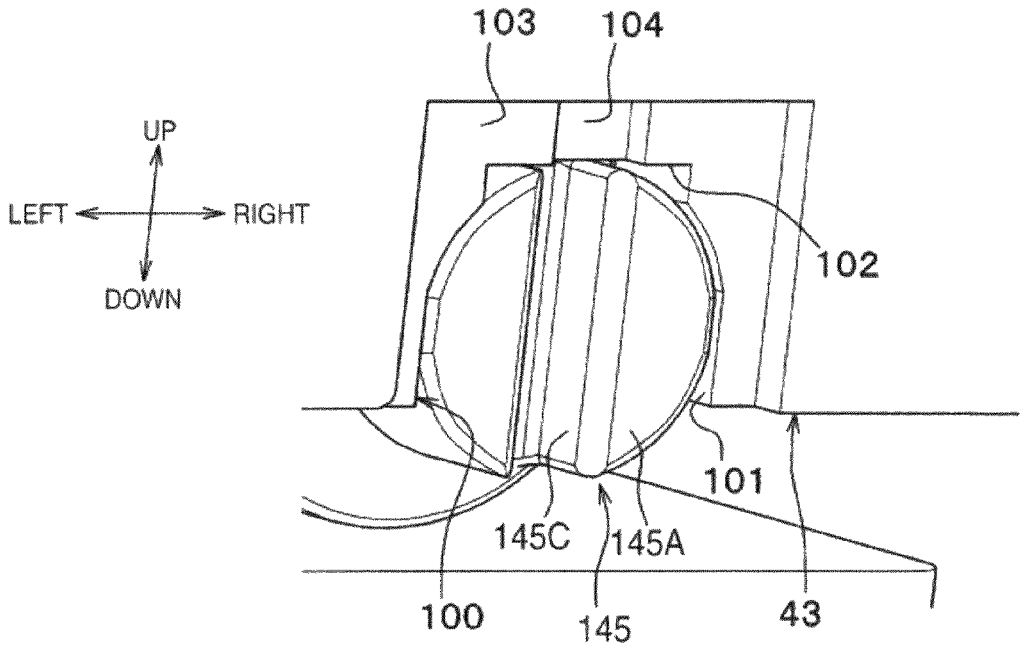
FIG. 12(*a*) is an enlarged perspective view illustrating a structure around a bearing portion and FIG. 12(*b*) is an enlarged perspective view illustrating a state where an adhesive is filled in a concave portion around the bearing portion.
Figure 12:
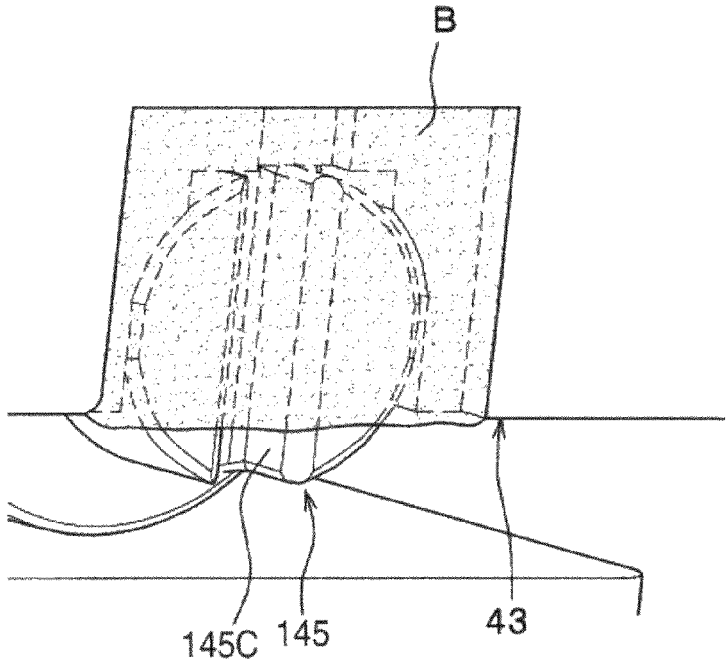
Figure 13:
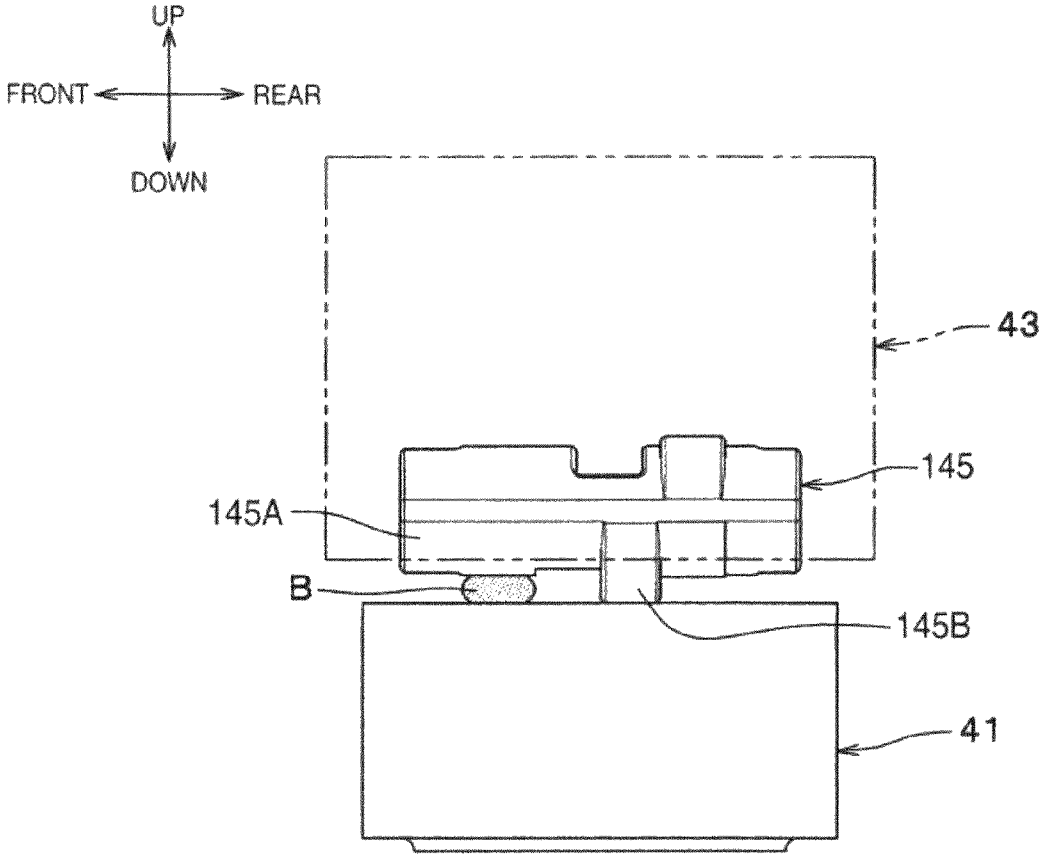
FIG. 13 is a side view illustrating a state where an adhesive is applied between a shaft of the first cam and the LED head.

As shown in FIG. 12(*a*), the bearing portion 100 has a U groove shape and a first concave portion 102 recessed upward is formed in the curved portion of the inner surface 101 of the U shape. A rectangular second concave portion 108 is formed outside the bearing portion 100 in the front and rear directions.

Specifically, the second concave portion 103 is recessed inward in the front and rear directions from the front surface (or the rear surface) of the support frame 48, is opened outward in the front and rear directions, and is opened downward. A third concave portion 104 being recessed inward in the front and rear directions and communicating with the first concave portion 102 of the bearing portion 100 is formed above the second concave portion 103.

An end of the minus groove 145C of the first cam 145 rotatably supported by the bearing portion 100 is located in the second concave portion 103 regardless of the direction of the first cam 145. Specifically, when the minus groove 145C is parallel to the lateral direction (when it is parallel to the lower end surface of the second concave portion 103), both ends (one) of the minus groove 145C is located in the second concave portion 103.

As shown in FIG. 12(*b*), when an adhesive B is filled in the concave portions 102 to 104, the adhesive B is also filled in the minus groove 145C of the first cam 145 and thus the support frame 43 and the first cam 145 are strongly fixed to each other. That is, by applying the adhesive B to connect the concave portions 102 to 104 to the first cam 145, a rotation stopper of the fist cam 145 is formed by the hardened adhesive B and the concave portions 102 and 104.

As shown in FIG. 13, the adhesive B is applied between the shaft 145A of the first cam 145 and the LED head 41.

According to the above-mentioned configuration, the following advantages can be obtained in this embodiment.

Since the bearing portions 100 supporting the shafts 145A and 146A of the eccentric cams 145 and 146 are disposed in the support frame 43 other than the LED head 41, it is possible to prevent the deformation of the LED head 41, thereby improving the image quality.

Since the length of the eccentric cams 145 and 146 is smaller than the width of the LED head 41 and the support frame 43, the eccentric cams 145 and 146 do not protrude in the front and rear directions from the LED head 41 and the support frame 43. Accordingly, since the eccentric cams 145 and 146 do not interfere with the structure around the photosensitive drum 53, the degree of freedom in design is enhanced. Since a user carelessly comes in contact with the eccentric cams 145 and 146, the LED head 41 can be kept at a regular position, thereby enhancing the reliability.

In addition, the support frame 43 is firmed of resin. Accordingly, when the shape of the bearing portions 100 of the eccentric cams 145 and 146 is complicated, they can be formed easily. Additionally, a reinforcing rib can be easily provided to the support frame 43.

Since the adhesive B is disposed to connect the concave portions 102 to 104 formed in the support frame 43 to the eccentric cams 145 and 146, the rotation of the eccentric cams 145 and 146 can be regulated thanks to the engagement of the hardened adhesive with the concave portions 102 to 104, thereby keeping the LED head 41 at a regular position.

The first concave portion 102 is formed in the inner surface 101 of the bearing portion 100. Accordingly, when the adhesive B in the second concave portion 103 and the third concave portion 104 exposed from the surface is peeled off by the user, but the adhesive B remains in the first concave portion 102, the rotation of the eccentric cams 145 and 146 can be regulated by only the remaining adhesive. In addition, since it is difficult for the user to peel off the adhesive B remaining in a narrow space in the first concave portion 102, the adhesive B in the first concave portion 102 can be surely used as the rotation stopper.

Since the minus grooves 145C and 146C into which the adhesive B is injected are formed in the eccentric cams 145 and 146, it is possible to regulate the rotation of the eccentric cams 145 and 146 by the engagement of the hardened adhesive B with the minus grooves 145C and 146C.

Since the minus grooves 145C and 146C are formed at the ends of the eccentric cams 145 and 146, the minus grooves 145C and 146C can be used as a groove for stopping the rotation as described above and can be also used as a groove for operating the eccentric cams 145 and 146.

Since the ends of the minus grooves 145C and 146C are located in the second concave portion 103 regardless of the directions of the eccentric cams 145 and 146, the adhesive B is injected into the minus grooves 145C and 146C of the eccentric cams 145 and 146 at the time of applying the adhesive B to the second concave portion 103, thereby easily performing the operation of filling the adhesive B.

The adhesive B is filled between the shaft 145A of the first cam 145 and the LED head 41. Accordingly, even when the LED head 41 is inclined oblique about a line connecting an operating point of the first cam 145 and an operating point of the second cam 146, the inclination can be suppressed by the adhesive B.

Since the operating portions 145B and 146B of the eccentric cams 145 and 146 have a semicircular shape, it is not necessary to form a concave portion for evacuation from the operating portion in the support frame 43, compared with the eccentric cam in which a circular operating portion is formed eccentrically in the shaft, thereby enhancing the strength of the support frame 43. By the eccentric cam 145 can rotate in only one direction (counterclockwise in FIG. 2) by allowing the linear section of the semicircular eccentric cam 145 to engage with the support frame 43, an erroneous operation can be prevented in which the LED head 41 does not move by the operation of the eccentric cam in the reverse direction, thereby performing a rapid adjustment.

The invention is not limited to the above-mentioned embodiment, but may be modified in various forms as described below.

In the second embodiment, the eccentric cams 145 and 146 are employed as the cam, but the invention is not limited to this configuration. For example, an egg-like cam or the like may be employed.

In the second embodiment, the concave portions 102 to 104 are formed around the bearing portion 100, but the invention is not limited to this configuration. For example, the concave portions may be formed at a position apart from the bearing portion 100.

Figure 6:
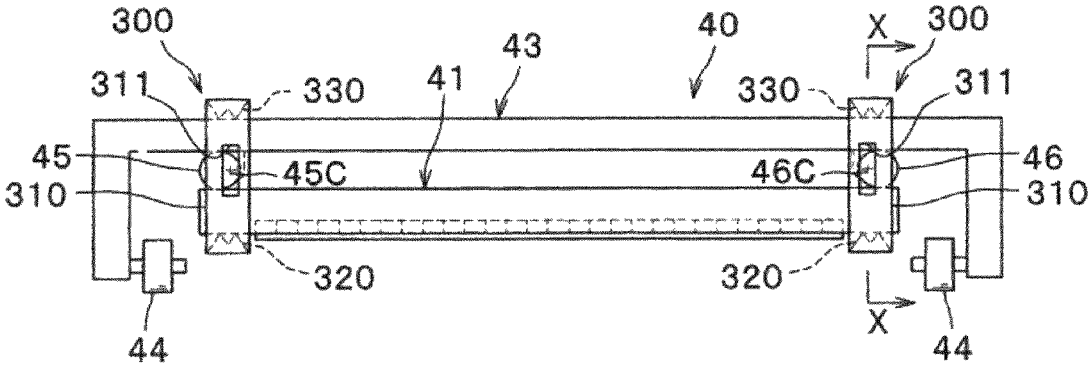
FIG. 6(*a*) is a font view illustrating an example where a leaf spring is employed as an elastic member and FIG. 6(*b*) is a sectional view taken along line X-X of FIG. 5(*a*).
Figure 6:
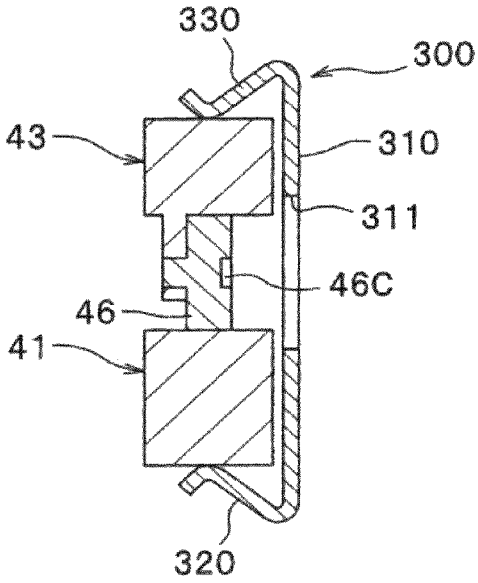

The modified example described with reference to FIGS. 6(*a*) and 6(*b*) and FIG. 8 can be applied to the second embodiment.

In the second embodiment, the minus grooves 145C and 146C are employed as the hole portion, but the invention is not limited to this configuration. For example, a bottomed cylindrical hole may be employed or grooves having various shapes may be employed.

In the first embodiment and the second embodiment, the length of the eccentric cams 45, 46, 145, and 146 is smaller than the widths of both the LED head 41 and the support frame 43, but the invention is not limited to this configuration. It is enough as long as the length of the cams can be smaller than one of the widths of the support frame 43 and the LED head 41.

In the first embodiment and the second embodiment, the axis direction of the eccentric cams 45, 46, 145, and 146 is parallel to the front and rear directions, but the invention is not limited to this configuration. For example, the axis direction may be parallel to the lateral direction. In this case, the size of the cam (for example, the maximum length of the operating portion of the cam) corresponding to the width (in the front and rear directions) of the support frame 43 and the like can be smaller than the width of the support frame 43 and the like.

In the first embodiment and the second embodiment, the elastic member (line springs 42) is employed as the fixing member, but the invention is not limited to this configuration. For example, a coupling band or an adhesive not elastically deformed may be employed. In this way, when a member not elastically deformed is used as the fixing member, for example, the line spring 42 shown in FIG. 5(*c*) can be used as a jig at the time of manufacturing it.

That is, as shown in FIG. 5(*c*), after the operating distance S is adjusted using the urging force of the line spring 42 in the fourth process, the LED head 41 may be fixed to the support frame 43 with the coupling band or adhesive not elastically deformed and then the line spring 42 may be removed. In this case, it is preferable that the eccentric cams 45 and 46 are fixed to at least one of the LED head 41 and the support frame 43 with an adhesive to disable the rotation thereafter. According to this configuration, since the eccentric cams 45, 46, 145, and 146 are not movable after adjusting the operating distance S, the operating distance S can be satisfactorily kept at a desired value.

In addition to the line spring 42, a leaf spring or an air cylinder may be used as the jig pressing the LED head 41 to the support frame 48 at the time of adjusting the operating distance S.

In the first embodiment and the second embodiment, the coil spring 47 is employed as the pressing member, but the invention is not limited to this configuration. The pressing member may employ a torsion spring or a disc spring.

In the first embodiment and the second embodiment, the LED head 41 having the plural LED head arrays 41A arranged in a line in the lateral direction is employed as the exposure member, but the invention is not limited to this configuration. For example, an LED head having plural lines in the front and rear directions in which plural LEDs are arranged in the lateral direction may be employed. A structure may be employed which includes plural light emitting portions formed by one light emitting element such as an LED or a fluorescent lamp and an optical shutter of plural liquid crystal or PLZT elements arranged in the lateral direction outside the light emitting element. The light source is not limited to the LED, but may include an electroluminescence (EL) element or a fluorescent member.

In the first embodiment and the second embodiment the invention is applied to the color printer 1, but the invention is not limited to it. The invention may be applied to other image forming apparatuses such as a copier or a multifunction machine.

In the above-mentioned embodiments, the photosensitive drum 53 is employed as the photosensitive member, but the invention is not limited to this configuration. For example, a photosensitive member having a belt shape may be employed.

As discussed above, the invention can provide at least the following illustrative, non-limiting embodiments:

(1) An image forming apparatus including: a photosensitive member on which an electrostatic latent image is to be formed; an exposure member having plural light emitting portions arranged in an axis direction of the photosensitive member and being configured expose the photosensitive member; a support frame supporting the exposure member; a fixing member fixing the exposure member to the support frame; a gap keeping member disposed between the support frame and the photosensitive member and configured to come in contact with the photosensitive member to keep a gap between the photosensitive member and the exposure member with the support frame interposed therebetween; a pressing member configured to press the gap keeping member to the photosensitive member with the support frame interposed therebetween; and an adjustment member disposed between the exposure member and the support frame and configured to adjust a gap between the exposure member and the support frame to allow the exposure member to move in an optical axis direction.

Here, the "axis direction of the photosensitive member" means an axis direction of a photosensitive drum which is the photosensitive member and means an axis direction of a support shaft when the photosensitive member includes a belt and the support shaft rotatably supporting the belt.

The "fixing member" may be an elastic member or may be a coupling band or an adhesive not elastically deformed. When the elastic member is employed, the adjustment of the gap between the exposure member and the photosensitive member can be carried out allowing a part of the adjustment member to advance and retreat in the optical axis direction and thus allowing the exposure member to move in the optical axis direction while pressing the exposure member to the support frame by the use of the elastic member. After the adjustment, the exposure member can be pressed and fixed to the support frame (adjustment member) by the elastic member.

When a member not elastically deformed is employed as the fixing member, the adjustment of the gap between the exposure member and the photosensitive member can be carried out by allowing at least a part of the adjustment member to advance and retreat in the optical axis direction and thus allowing the exposure member to move in the optical axis direction while pressing the exposure member to the support frame, for example, by the use of an air cylinder or the like. After the adjustment, the adjustment member can be fixed to the support frame by the use of the fixing member not elastically deformed.

According to the image forming apparatus of (1), the gap keeping member is disposed between the support frame and the photosensitive member and the adjustment member is disposed between the exposure member and the support frame to adjust the gap between the exposure member and the support frame. Accordingly, compared with the related case where the gap keeping member and the adjustment member are disposed in a narrow gap between the exposure member and the photosensitive member, it is possible to increase the sizes of the gap keeping member and the adjustment member. As a result, it is possible to precisely set the operating distance. Since the gap keeping member keeps the gap between the exposure member and the photosensitive member with the support frame interposed therebetween, the pressing member presses the gap keeping member to the photosensitive member with the support frame interposed therebetween and thus a load from the pressing member is not applied to the exposure member supported by the support frame with the fixing member interposed therebetween, thereby preventing the deformation of the exposure member.

(2) An image forming apparatus including: a photosensitive member on which an electrostatic latent image is to be formed; an exposure member having plural light emitting portions and being configured to expose the photosensitive member; a support frame supporting the exposure member; a gap keeping member disposed between the support frame and the photosensitive member and configured to keep a gap between the photosensitive member and the exposure member; and a cam disposed between the exposure member and the support frame and configured to adjust a gap between the exposure member and the support frame, wherein the support frame includes a bearing portion configured to rotatably supporting a shaft of the cam.

According to the image forming apparatus of (2), since a concave portion for avoiding a head of the cam need not be formed in the exposure member by providing the support frame with the bearing portion supporting the shaft of the cam, it is possible to prevent the deformation of the exposure member, thereby improving the image quality.

What is claimed is:

1. An image forming apparatus comprising:

a photosensitive member;

an exposure member configured to expose the photosensitive member, the exposure member having plural light emitting portions arranged in an axis direction of the photosensitive member;

a support frame supporting the exposure member;

a fixing member fixing the exposure member to the support frame;

a gap keeping member disposed between the support frame and the photosensitive member and configured to come in contact with the photosensitive member to keep a gap between the photosensitive member and the exposure member;

a pressing member configured to urge the support frame to press the gap keeping member to the photosensitive member; and an adjustment member disposed between the exposure member and the support frame and configured to adjust a gap between the exposure member and the support frame to allow the exposure member to move in an optical axis direction, wherein the support frame, the adjustment member and the exposure member overlap as viewed along the optical axis direction.

2. The image forming apparatus according to claim 1, wherein an adjustment plate is disposed between the adjustment member and the exposure member or between the adjustment member and the support frame.

3. The image forming apparatus according to claim 1, wherein the fixing member includes an elastic member.

4. The image forming apparatus according to claim 3, wherein the elastic member is configured so that an operating portion of the elastic member applies an urging force to the exposure member in an urging direction, the operating portion and the adjustment member are disposed outside the light emitting portions of the exposure member in the axis direction, and the operating portion and the adjustment member overlap with each other as viewed in the urging direction of the elastic member.

5. The image forming apparatus according to claim 4, wherein the elastic member includes a leaf spring having an opening, through which the adjustment member is at least partly exposed to be operable.

6. The image forming apparatus according to claim 4, wherein the elastic member includes a line spring that is bent to at least partly expose the adjustment member so that the adjustment member is operable.

7. The image forming apparatus according to claim 4, wherein the operating portion of the elastic member is smaller than a contact portion between the adjustment member and the exposure member or the support frame, and wherein the operating portion is disposed within a range of the contact portion as viewed in the urging direction of the elastic member.

8. The image forming apparatus according to claim 4, wherein the adjustment member has two contact portions coming in contact with the exposure member or the support frame, and wherein the operating portion of the elastic member is smaller than a range between the two contact portions and is disposed between the two contact portions.

9. The image forming apparatus according to claim 1, wherein the adjustment member contacts the exposure member or the support frame at three contact portions.

10. The image forming apparatus according to claim 1, wherein the adjustment member includes an eccentric cam.

11. A method of manufacturing an image forming apparatus comprising:

a first process of setting an exposure member in a first jig having a first optical sensor and measuring a displacement amount of a focal position of light by emitting the light from the exposure member to the first optical sensor;

a second process of determining whether an adjustment plate should be disposed on the basis of the displacement distance of the focal position;

a third process of detaching the exposure member from the first jig, attaching a gap keeping member to a support frame that supports the exposure member, and disposing an adjustment member between the exposure member and the support frame to allow the exposure member to move in an optical axis direction, and optionally the adjustment plate based on a result of determination by the second process, between the exposure member and the support frame; and a fourth process of setting the support frame in a second jig in a state where the gap keeping member is brought into contact with a reference surface of the second jig having a second optical sensor, emitting light from the exposure member to the second optical sensor while pressing the exposure member to the support frame, and adjusting the focal position of the light to a desired position relative to the reference surface by operating the adjustment member.

12. The method according to claim 11, further comprising fixing the adjustment member to at least one of the exposure member and the support frame with an adhesive after the fourth process.

13. An image forming apparatus comprising:

a photosensitive member;

an exposure member configured to expose the photosensitive member, the exposure member having plural light emitting portions;

a support frame supporting the exposure member;

a gap keeping member disposed between the support frame and the photosensitive member and configured to keep a gap between the photosensitive member and the exposure member; and a cam disposed between the exposure member and the support frame and configured to adjust a gap between the exposure member and the support frame, wherein the support frame includes a bearing portion configured to rotatably support the cam, and wherein the support frame, the cam and the exposure member overlap as viewed along the optical axis direction.

14. The image forming apparatus according to claim 13, wherein a size of the cam in a direction of a width of the exposure member or the support frame is smaller than the width.

15. The image forming apparatus according to claim 13, wherein the support frame is formed of resin.

16. The image forming apparatus according to claim 13, wherein a concave portion is formed in the support frame, and wherein an adhesive is applied to the concave portion and the cam to connect the concave portion and the cam to each other.

17. The image forming apparatus according to claim 16, wherein the concave portion is formed in an inner surface of the bearing portion.

18. The image forming apparatus according to claim 16, wherein the cam has a hole portion into which the adhesive enters.

19. The image forming apparatus according to claim 18, wherein the hole portion includes a groove at an end of the cam.

20. The image forming apparatus according to claim 19, wherein the groove passes through the cam in a diametric direction of the cam, and wherein an end of the groove in the diametric direction is located in the concave portion regardless of degree of rotation of the cam.

21. The image forming apparatus according to claim 13, wherein the cam includes:

a first cam disposed closer to one end of the exposure member to press the exposure member at a point; and a second cam disposed closer to another end of the exposure member to press the exposure member at two points, and wherein an adhesive is applied between a shaft of the first cam and the exposure member.

* * * * *